US006422991B1

(12) United States Patent
Jaeger

(10) Patent No.: US 6,422,991 B1
(45) Date of Patent: Jul. 23, 2002

(54) IMPLANTABLE MICROPHONE HAVING IMPROVED SENSITIVITY AND FREQUENCY RESPONSE

(75) Inventor: Eric M. Jaeger, Redwood City, CA (US)

(73) Assignee: Symphonix Devices, Inc., San Jose, CA (US)

( * ) Notice: Subject to any disclaimer, the term of this patent is extended or adjusted under 35 U.S.C. 154(b) by 61 days.

(21) Appl. No.: 09/613,901

(22) Filed: Jul. 11, 2000

Related U.S. Application Data

(63) Continuation-in-part of application No. 08/991,447, filed on Dec. 16, 1997, now Pat. No. 6,093,144.

(51) Int. Cl.[7] ..... H04R 25/00

(52) U.S. Cl. ..... 600/25

(58) Field of Search ..... 600/25, 23, 483, 600/484, 515, 823; 181/128–137; 381/68; 607/55–57; 434/112

(56) References Cited

U.S. PATENT DOCUMENTS

| | | | |
|---|---|---|---|
| 2,702,354 | A | 2/1955 | Chorpening |
| 3,736,436 | A | 5/1973 | Crites |
| 3,938,615 | A | 2/1976 | Bodenger |

(List continued on next page.)

FOREIGN PATENT DOCUMENTS

| | | |
|---|---|---|
| JP | 54-133125 | 10/1979 |
| JP | 58-38098 | 3/1983 |
| JP | 6-225385 | 8/1994 |
| WO | WO 97/44987 | 11/1997 |

OTHER PUBLICATIONS

Deddens, A.E. et al., "Totally Implantable Hearing Aids: The Effects of Skin Thickness on Microphone Function." *Am. J. Otolaryngol.*, (1990) vol. 11, pp. 1–4.

HNO–Hals–Nasen–Ohren–Heilkunde, Kopf–und Hals–Chirurgio, Preprint of Abstracts, "Fully Implantable Hearing Aid TICA LZ 3001 Product Summary," (Oct. 1997) vol. 45, 5 pages total.

Ohno, Tohru "The Implantable Hearing Aid, Part I," (Fall 1984) *Audecibel*, pp. 28–30.

Schellin, R. et al., "Corona–poled piezoelectric polymer layers of P(VDF/TrFE) for micromachined silicon microphones," *J. Micromach. Microeng.* (Jan. 1995) vol. 5, pp. 106–108.

Scheeper, P.R. et al. "Improvement of the performance of microphones with a silicon nitride diapragm and backplate," *Sensors and Actuators A*, (1994) vol. 40, pp. 179–186.

(List continued on next page.)

*Primary Examiner*—Eric F. Winakur
*Assistant Examiner*—Nikita R Veniaminov
(74) *Attorney, Agent, or Firm*—Townsend and Townsend and Crew LLP

(57) ABSTRACT

This invention relates to an implantable microphone device. The implantable microphone device typically comprises a housing defining an internal chamber. It typically further comprises a microphone arrangement on the housing, the microphone arrangement having a first cavity, a second cavity, and a membrane separating the first and second cavities such that vibrations entering the first cavity causes the membrane to vibrate, and to transmit vibrations into the second cavity. The implantable microphone device further comprises at least one vent extending between the second cavity of the microphone arrangement and the internal chamber of the housing so as to permit the vibrations to pass from the second cavity of the microphone arrangement into the internal chamber of the housing.

36 Claims, 12 Drawing Sheets

U.S. PATENT DOCUMENTS

| | | | |
|---|---|---|---|
| 4,281,222 | A | 7/1981 | Nakagawa et al. |
| 4,524,247 | A | 6/1985 | Lindenberger et al. |
| 4,591,668 | A | 5/1986 | Iwata |
| 4,597,099 | A | 6/1986 | Sawafuji |
| 5,085,628 | A | 2/1992 | Engebretson et al. |
| 5,146,435 | A | 9/1992 | Bernstein |
| 5,148,492 | A | 9/1992 | Uzawa et al. |
| 5,303,210 | A | 4/1994 | Bernstein |
| 5,329,593 | A | 7/1994 | Lazzeroni |
| 5,452,268 | A | 9/1995 | Bernstein |
| 5,624,376 | A | 4/1997 | Ball et al. |
| 5,624,377 | A | 4/1997 | Davis |
| 5,814,095 | A | 9/1998 | Muller et al. |
| 5,859,916 | A | 1/1999 | Ball et al. |
| 5,881,158 | A | 3/1999 | Lesinski et al. |

OTHER PUBLICATIONS

Suzuki, Jun–Ichi et al. "Early Studies and the History of Development of the Middel Ear Implant in Japan." *Adv. Audiol*. (1988) vol. 4, pp. 1–14.

Yanagihara, Naoaki, M.D. et al., "Development of an Implantable Hearing Aid Using a Piezoelectric Vibrator of Bimorph Design: State of the Art." *Otolaryngology Head and Neck Surgery*, (Dec. 1984) vol. 92, No. 6, pp. 706–712.

IMPLANTABLE MICROPHONE HAVING IMPROVED SENSITIVITY AND FREQUENCY RESPONSE

CROSS-REFERENCES TO RELATED APPLICATIONS

This application is a continuation-in-part of and claims priority from U.S. patent application Ser. No. 08/991,447, filed Dec. 16, 1997, now U.S. Pat. No. 6,093,144 the full disclosure of which is incorporated herein by reference.

BACKGROUND OF THE INVENTION

The present invention is related to hearing systems and, more particularly, to implantable microphone devices that may be utilized in hearing systems.

Conventional hearing aids are placed in the ear canal. However, these external devices have many inherent problems including the blockage of the normal avenue for hearing, discomfort because of the tight seal required to reduce the squeal from acoustic feedback and the all-too-common reluctance for hearing-impaired persons to wear a device that is visible.

Recent advances in miniaturization have resulted in the development of hearing aids that can be placed deeper in the ear canal such that they are almost unnoticeable. However, smaller hearing aids inherently have problems, which include troublesome handling and more difficult care.

Implantable hearing devices offer the hope of eliminating problems associated with conventional hearing aids. One requirement for a fully implantable hearing device or system is an implantable microphone.

All microphones necessarily contain an interface between the internal components and the environment in which it will be situated. For non-piezoelectric designs, air-conduction microphones utilize a diaphragm, or membrane, which can be made of various materials, stretched or formed to varying tensions. The tension in the diaphragm has a first order effect on the response of the microphone. A highly stretched diaphragm will tend to resonate at a high frequency, with a flat response at frequencies below the resonance. However, a higher tension in the diaphragm will also tend to lower the sensitivity of the microphone.

Prior art implantable microphones for use with hearing systems have comprised an electret microphone disposed within an air cavity, enclosed by a stretched stainless steel diaphragm. The air cavity is hermetically sealed, necessitated by implantation in the body. The diaphragm is stretched tight and laser welded. The resulting system frequency response therefore has a low sensitivity and a sharp high frequency resonance peak. An improved device response would have high sensitivity, comparable to an electret microphone alone in air, and would be generally flat across the audio frequency, especially in the range of speech (500–4,000 Hz). Additional requirements for an improved implanted microphone include low distortion and low noise characteristics.

Traditional, non-implantable type microphones have an air cavity behind the diaphragm that is not sealed, with reference to the nearest surface behind the diaphragm. Traditional microphones are concerned with optimal diaphragm displacement, and typically have several air cavities which are used to influence the shape of the microphone response. An implantable microphone design that incorporates a diaphragm, enclosing a sealed chamber containing an electret microphone, for example, is necessarily concerned with an optimal pressure build-up in the sealed cavity. This pressure build-up in turn displaces a membrane of the electret microphone. However, a sealed air cavity presents new challenges to the design and optimization of implantable microphones.

With the advent of fully implantable microphone devices for stimulating hearing, there is a great need for implantable microphones that provide excellent audio performance. The present invention provides improved audio performance through improvement of implantable microphone device design.

SUMMARY OF THE INVENTION

The present invention provides implantable microphone devices that may be utilized in hearing systems, particularly in systems having bone mounted and other implantable drivers. The device comprises a flexible, substantially unstressed, diaphragm disposed over a sealed cavity. The diaphragm may be made to be substantially flexible, or substantially unstressed, by etching or forming the diaphragm until it is very thin. Also, the sealed cavity may be limited to a very small volume so as to decrease the sealed cavity acoustic compliance. Both of these examples simultaneously increase overall sensitivity of the device and move the damped resonance peak to higher frequencies.

In accordance with one aspect of the invention, an implantable microphone device is provided which comprises a housing and a membrane disposed over a surface of the housing to define a primary air cavity therebetween. A microphone assembly is secured within the housing. The microphone assembly has a secondary air cavity and an aperture which couples the secondary air cavity to the primary air cavity so that vibrations of the membrane, or diaphragm, are transmitted through the primary air cavity and aperture to the secondary air cavity. A microphone transducer is disposed in the secondary air cavity to detect said transmitted vibrations. Preferably, the microphone transducer comprises an electret membrane, a backplate, and electrical leads. Advantageously, a protective cover over the membrane, or diaphragm, is provided to protect the membrane from direct impact, where the protective cover is perforated to allow for free flow of vibration to the membrane.

In one configuration, the housing further includes a rear, or internal, chamber. The rear chamber encases electric leads to the microphone, and provides external access to the leads through a hermetic feedthrough.

In yet another configuration, the membrane, or diaphragm, may comprise at least one compliance ring. Preferably, a plurality of compliance rings may be used. The compliance ring may be either etched or formed into the membrane, or diaphragm, or otherwise secured to it by any suitable means.

In accordance with another aspect of the invention, surface details are positioned on a surface of the housing. Preferably, the surface details may include pits, grooves, or at least one hole which connects the primary air cavity to a rear, or internal, chamber of the housing. The surface details are provided to increase resonance peak damping.

In accordance with yet another aspect, the implantable microphone comprises a housing comprising a rear, or internal, chamber and includes a thin-walled tube section or other port opening for filling or evacuating specialty gases from said chamber. Filling the various cavities of the microphone with specialty gases decreases the acoustic compliance of those cavities. Accordingly, the housing further comprises a microphone assembly, or arrangement, which may be vented, such that the gases can permeate each cavity of the implantable microphone. Alternatively, surfaces details on the housing, such as holes, may also connect the various cavities of the microphone device.

In accordance with a further aspect, the implantable microphone device, comprises a biocompatible material positioned proximate to the membrane, or diaphragm. Preferably, the biocompatible material is biodegradable and degrades over time. Example materials include lactide and glycolide polymers. The position of the biocompatible material may vary from, for example, simple contact with only the front surface of the membrane, or diaphragm, to complete encapsulation of the entire microphone. This material provides protection from initial tissue growth on the microphone which may occur after implantation of the device. A volume occupying layer may be used to occupy a space between the membrane, or diaphragm, and an opposing surface of the biocompatible material. The volume occupying layer may naturally, over time, permanently fill up with body fluids or may comprise a permanent, biocompatible fluid-filled sack. In either form, these fluids will maintain an interface between the membrane and the surrounding tissue.

In accordance with yet another aspect, the implantable microphone device comprises a microphone assembly, or arrangement, with the secondary air cavity removed such that the electret membrane is directly exposed to the primary air cavity. The removal of the secondary air cavity creates a further reduction in overall air cavity volume which leads to a reduction in the acoustic compliance of the microphone.

In accordance with still a further aspect, the implantable microphone device has a modified microphone assembly which eliminates the electret membrane. The assembly comprises an insulation layer secured on the inside surface of the implantable microphone membrane. An electret membrane-type material is, in turn, secured on the insulation layer. A backplate is disposed within the primary air cavity proximate to the insulation/membrane-type material combination. This aspect of the invention provides the advantage of a direct electret displacement, a lower overall component count, and an overall thinner microphone profile.

In accordance with another aspect, an implantable microphone device is provided and which comprises a housing defining a surface and a rear, or internal, chamber. The implantable microphone device further comprises a diaphragm coupled to the housing, the diaphragm being a substantially unstressed diaphragm and being disposed over the surface of the housing to define a primary cavity therebetween. The device yet further comprises a device through which a gas can be removed from or introduced into the rear, or internal, chamber, a microphone arrangement on the housing, the microphone arrangement having an aperture open to the primary cavity, an internal cavity coupled to the primary cavity through the aperture so that vibrations of the diaphragm are transmitted through the primary cavity and aperture into the internal cavity, and a vent connecting the internal cavity to the rear, or internal, chamber. It yet further comprises a microphone transducer disposed in the internal cavity of the microphone arrangement so as to detect said transmitted vibrations.

In accordance with another aspect, there is provided an implantable microphone device comprising a housing defining an internal chamber, a microphone arrangement on the housing, the microphone arrangement having a first cavity, a second cavity and a membrane separating the first and second cavities such that vibrations entering the first cavity cause the membrane to vibrate thereby to transmit the vibrations into the second cavity, and at least one vent extending between the second cavity of the microphone arrangement and the internal chamber of the housing so as to permit the vibrations to pass from the second cavity of the microphone assembly into the internal chamber of the housing.

DESCRIPTION OF THE SPECIFIC EMBODIMENTS

Figure 1:
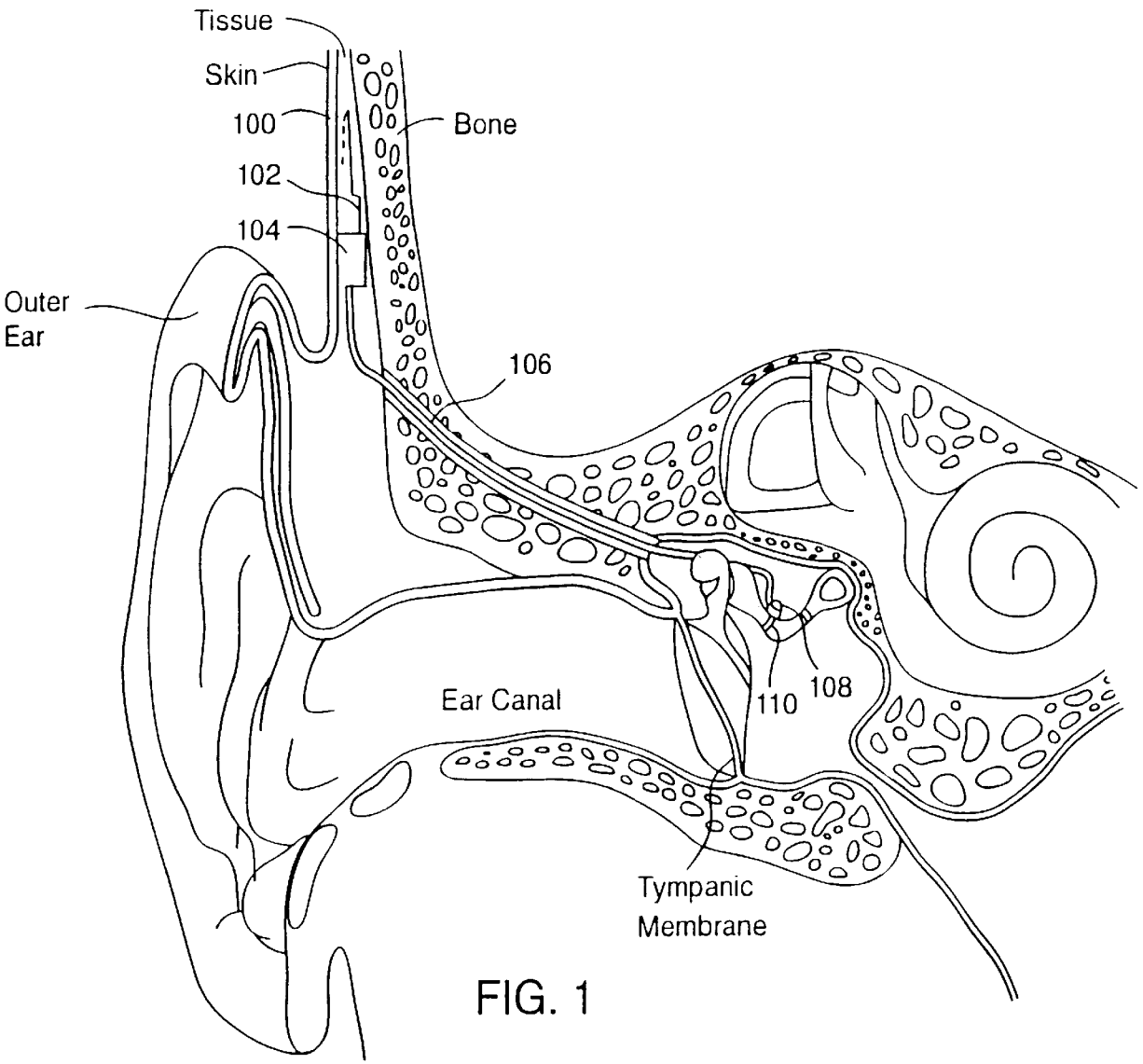
FIG. 1 shows a cross-sectional view of an implantable microphone in a hearing system.

In the description which follows, the present invention will be described with reference to hearing systems. The present invention, however, is not limited to any use or configuration. Therefore, the description of the embodiments that follow is for purposes of illustration and not limitation. The same reference numerals will be used to designate similar structures or parts, unless otherwise stated.

FIG. 1 illustrates an embodiment of the present invention in a hearing system. An implantable microphone device 100 is located under the skin and tissue behind the outer ear or concha. The implantable microphone device picks up sounds through the skin and tissue. The sounds are then translated into electrical signals and carried by leads 102 to a signal processor 104 which may also be located under the skin and tissue.

The signal processor 104 receives the electrical signals from the implantable microphone device 100 and processes the electrical signals appropriate for the hearing system and individual. An exemplary signal processor may include a battery and signal processing circuitry on an integrated circuit. For example, the signal processor may amplify certain frequencies in order to compensate for the hearing loss of a hearing-impaired person and/or to compensate for characteristics of the hearing system.

Electrical signals from the signal processor 104 travel via leads 106 to a driver, or direct-drive hearing device 108. The leads may pass through a channel in the bone as shown or may run under the skin in the ear canal (not shown). In a preferred embodiment, the direct-drive hearing device is a Floating Mass Transducer (FMT) described in U.S. application Ser. No. 08/582,301, filed Jan. 3, 1996 by Geoffrey R. Ball et al., which is hereby incorporated by reference for all purposes.

The direct-drive hearing device vibrates in response to the electric signals and transfers the vibration to the malleus by direct attachment utilizing a clip 110. Although the direct-drive hearing device is shown attached to an ossicle, device 108 may be attached to any structure that allows vibrations to be generated in the inner ear. For example, the direct-drive hearing device may be attached to the tympanic membrane, ossicle, oval and round windows, skull, and within the inner ear. However, if the implantable microphone and direct-drive device are both anchored to bone of the skull, it may be advantageous to isolate one of the devices to prevent feedback.

Figure 2A:
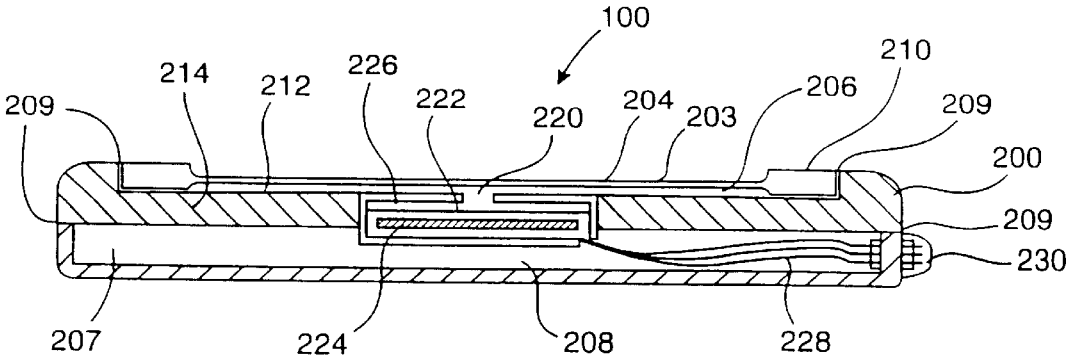
FIGS. 2A–2C show a cross-sectional view of an implantable microphone of the present invention.
Figure 2B:
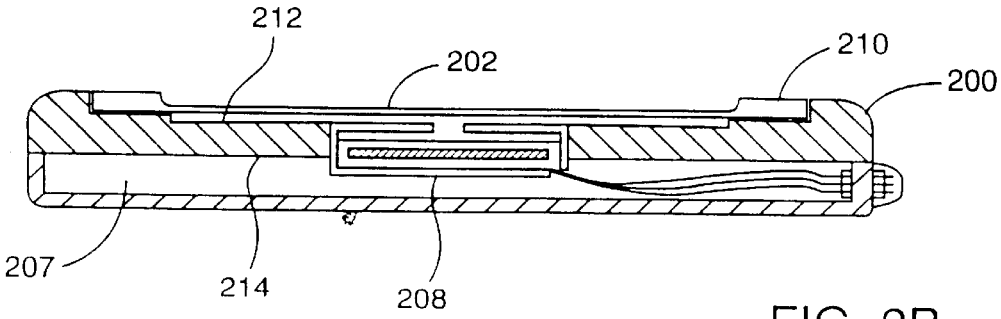
Figure 2C:
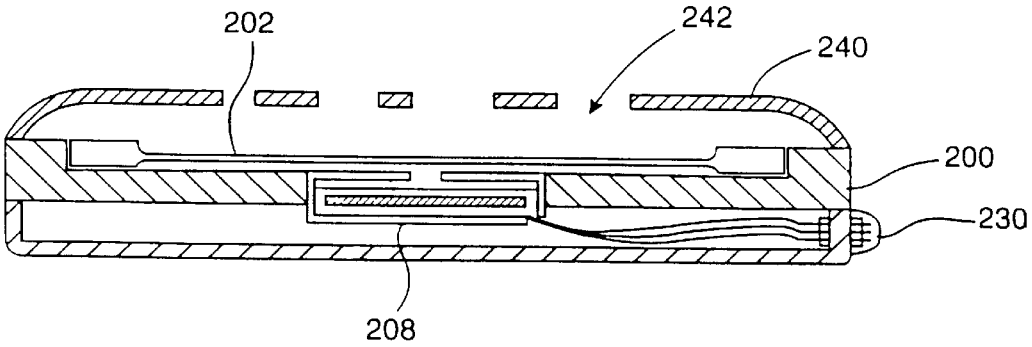

FIGS. 2A–2C show a cross-sectional view of an implantable microphone device of the present invention. Typically, implantable microphone device 100 is located under the skin and within the underlying tissue. In a preferred embodiment, the implantable microphone is placed against bone of the skull and may be attached to the bone (e.g., surgical screws). A shock absorbent material may be placed between the implantable microphone device and the bone of the skull for vibration isolation. The shock absorbent material may include silicone or polyurethane.

The implantable microphone generally includes a housing 200, a microphone assembly or arrangement 208, and a diaphragm 202. The diaphragm flexes, or vibrates, as it receives pressure or sound waves transmitted through the skin and tissue. In a preferred embodiment, the diaphragm 202 and housing 200 are both of a material which comprises titanium and are laser welded together as indicated at 209. In other embodiments, the housing 200 may be of a material which comprises ceramic and the diaphragm 202 may be of a material which comprises gold, platinum, stainless steel, or the like.

In order to increase the response of the microphone device, the diaphragm 202 should preferably be sufficiently flexible, or substantially unstressed. Increased diaphragm flexibility can be achieved, for example, by starting with a 0.0050" thick sheet of titanium (or other suitable material) and then chemically etching a circular portion of the sheet down to between 0.0005"–0.0020". Etching can be performed on one or both sides 203, 204 of the sheet to form the diaphragm 202. As a result, a circular peripheral band 210 of thicker (0.0050") titanium surrounds the diaphragm 202. The thick band 210 provides stability to the diaphragm 202, and keeps the diaphragm in a flexible, substantially unstressed, or only slightly stressed, state. The band 210 also provides for ease of attachment to the housing 200 at weld locations 209.

Preferably, the flexibility of the diaphragm 202 is defined in terms of the frequency response which it generates in open air, without an air cavity on either side. For example, the diaphragm will typically have a resonance frequency lower than 12,000 Hertz when measured by Laser Doppler Vibrometry. Resonance frequency measurements have been made with a Polytec Scanning Laser Doppler Vibrometer. In a preferred alternative, the flexibility of the diaphragm is defined as a function of its deflection when subjected to a force, centered on the diaphragm, supplied by a 3/32" diameter rod with a spherical tip. Force deflection measurements have been made with an Instron Tensile/Compression materials tester.

The diaphragm 202 disposed over the housing 200, defines a primary air cavity 206 therebetween. Although reference will be made to an "air" cavity, it will be appreciated that any other appropriate sound wave propagation medium can be used instead, such as, other types of gasses, or fluids, for example. The cavity 206 will typically be a hermetically sealed cavity necessitated by implantation into the body. Electro-acoustic simulation (lumped-parameter modeling), finite element analysis, and physical prototyping has shown that once the diaphragm is sufficiently flexible, or substantially unstressed, the one variable that has a first order effect on frequency response is the acoustic compliance of this air cavity. Increased device response is accomplished by decreasing the acoustic compliance of this air cavity. Acoustic compliance is determined by the following equation:

$$CA=V/\rho c^2=V/\gamma P_0$$

Where

V=volume of the air cavity

ρ=density of gas in the air cavity c=velocity of sound in the gas

γ=specific ratio of heats $P_0$=pressure of gas in air cavity

Preferably, the primary air cavity is defined as a volume that has an acoustic compliance of less than $4.3\times10^{-14}m^5/N$ measured parametrically.

From the equation above it can be seen that a decrease in compliance may be obtained through a decrease in air cavity volume. Accordingly, in a preferred embodiment, the primary air cavity 206 has a very small volume. The depth of the primary air cavity, can range, for example, from 0.0005" to 0.0020". In a preferred embodiment, the primary air cavity may define a specific volume of no greater than 6 cubic millimeters (0.00036 $in^3$). The depth of the primary air cavity 206 may be accomplished by machining a specified depth into a surface of the housing 212 or by etching the diaphragm lower surface 204 directly opposite the housing 200, or a combination of both procedures.

The decrease in acoustic compliance can also be achieved by increasing the bulk modulus of the gas in the primary air cavity, equal to $\rho c^2$. This may be accomplished by increasing the pressure in the chamber, or by using a gas with a higher density and velocity of sound than air. Typical gases may include, for example, xenon, argon, helium, nitrogen, and the like.

In one embodiment, the microphone arrangement 208 is an electret microphone. Instead, the microphone arrangement can be formed by etching, or otherwise forming, a body so as to have a cavity and membrane similar to that shown. The microphone arrangement 208 comprises an internal cavity 226, an electret membrane 222, a back plate 224, and an aperture or vent 220. The aperture 220 is connected to the primary air cavity 206 and allows vibrations of the diaphragm 202 to be transmitted as sound waves through the primary air cavity 206 and aperture 220 into the internal cavity 226. The sound waves passing through the internal cavity 226 generate vibrations on a surface of the electret membrane 222. The microphone comprises a transducer, and subsequently transforms these vibrations into electrical signals. Since the response is driven by the characteristics of the primary air cavity 206, the characteristics of the electret microphone 208 can be adjusted to enhance overall microphone 100 response. In one embodiment, the aperture 220 acts as an acoustic resistance at the front end of the electret microphone and is optimized such that the response peak of the response is damped, but overall sensitivity is minimally affected. This will create a flatter frequency response curve, and has been demonstrated with physical prototypes. In a preferred embodiment, leads 228 carry the electrical signals from the microphone 208 to a direct-drive hearing device (FIG. 1) which vibrates in response to the electric signals and transfers the vibration to the malleus or other appropriate inner ear structure.

The typical implantable microphone device 100 will include a rear, or internal, chamber 207. The rear chamber 207 is suited for encasing the leads 228 which pass from the electret microphone 208. A hermetically sealed feedthrough 230 is included in the housing 200 which allows the leads 228 to exit the rear chamber.

In another embodiment, the implantable microphone device 100 includes a protective cover 240. The protective cover protects the implantable microphone (and diaphragm) from damage when a user's head is struck with an object as may sometimes happen in contact sports. The protective cover 240 includes inlet ports 242 which allow sounds to travel to the membrane, or diaphragm, uninhibited. The protective cover 240 may be formed from any appropriate material, such as, plastic, stainless steel, titanium, ceramic, and/or the like.

Figure 3:
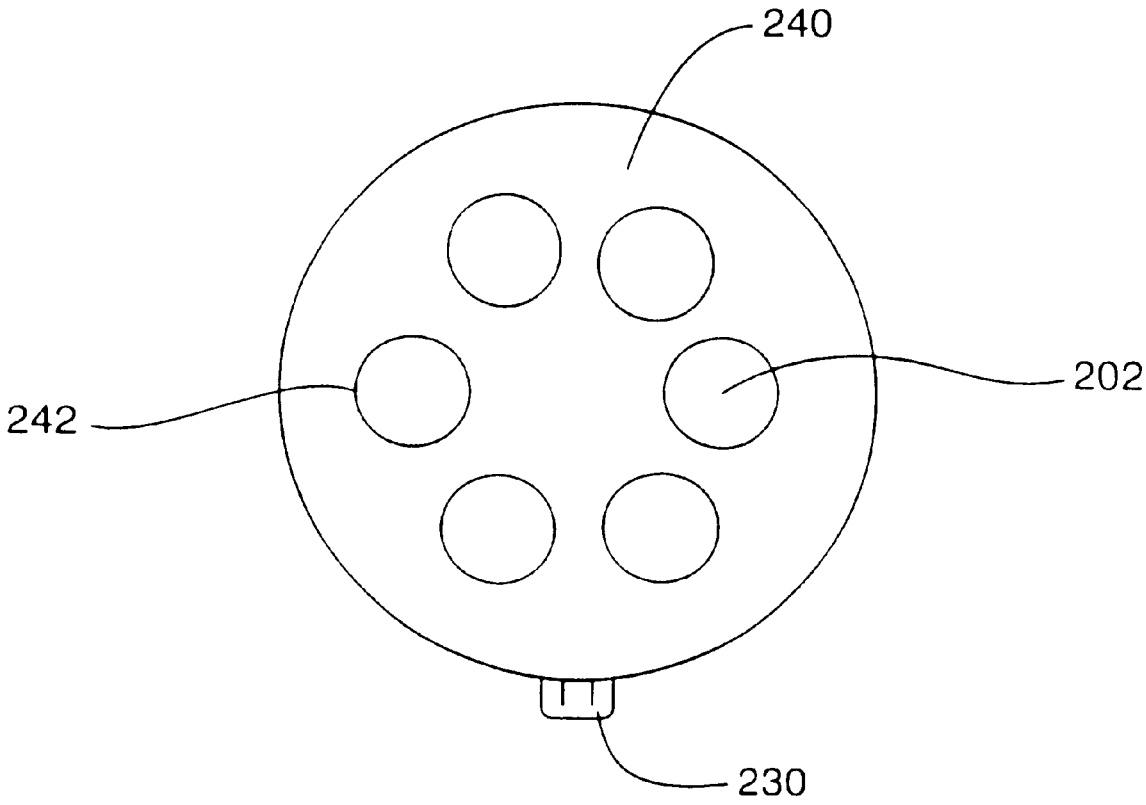
FIG. 3 shows a top view of a protective cover.

FIG. 3 shows a top view of such a protective cover. As shown, protective cover 240 (and therefore the underlying diaphragm 202) forms a major portion of the top surface area of the implantable microphone device. In this example, there are six inlet ports 242 through which sound may travel to the underlying diaphragm 202.

Figure 4A:
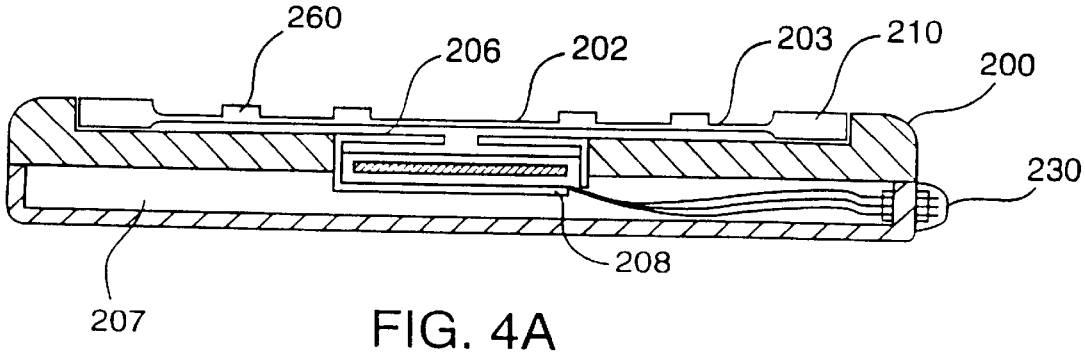
FIGS. 4A–4B show a cross-sectional view of an implantable microphone with compliance rings.
Figure 4B:
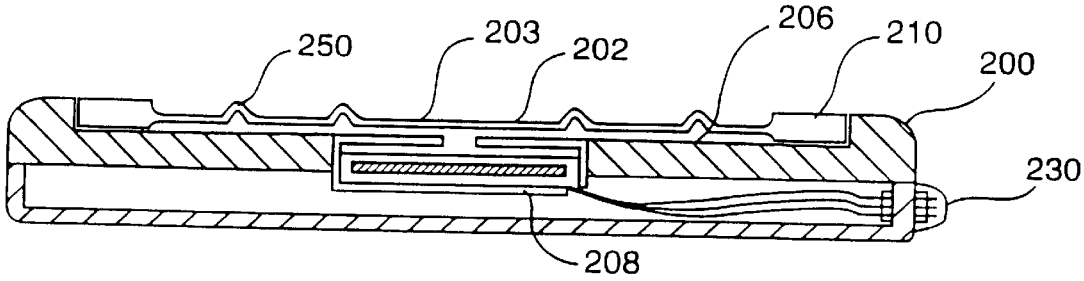
Figure 4C:
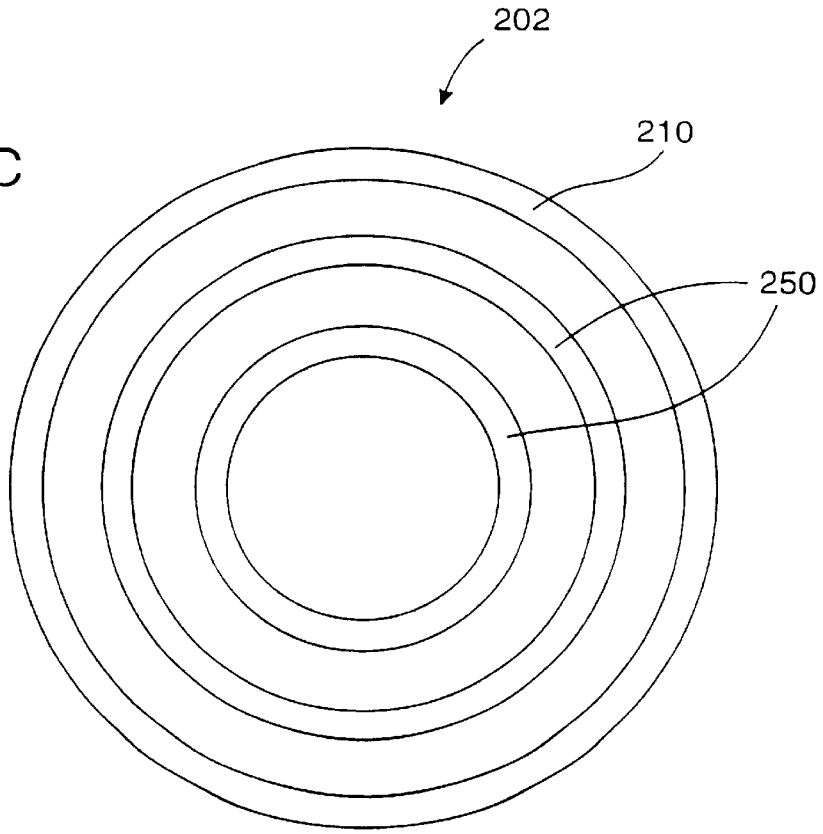
FIGS. 4C–4D show a top view of an implantable microphone with compliance rings.
Figure 4D:
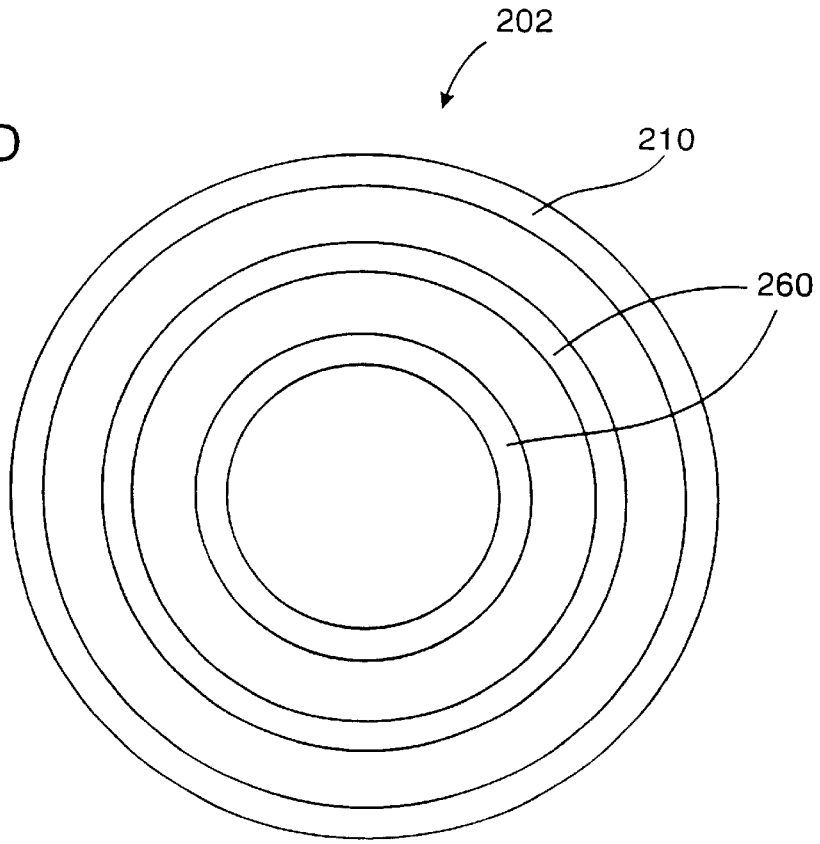

FIGS. 4A–4B show a cross-sectional view of an implantable microphone device with compliance rings. In a preferred embodiment, the compliance rings are provided to ensure a smooth frequency response by creating a single node, piston-like displacement of the diaphragm. The compliance rings may be fabricated using two different methods. FIG. 4A shows a cross-sectional view of the diaphragm 202 that has been depth etched to form rings 260 having a rectangular cross-section. The cross-sectional shape of the rings 260 is a function of the manufacturing process (i.e. depth of etching). An alternative manufacturing process, shown in FIG. 4B, provides compliance rings 250 formed mechanically, for example, by stamping. These rings may provide additional flexibility to the diaphragm. FIGS. 4C and 4D show a top view of the diaphragm 202 and further show how the rings 250, 260 may be positioned on the diaphragm.

Figure 5A:
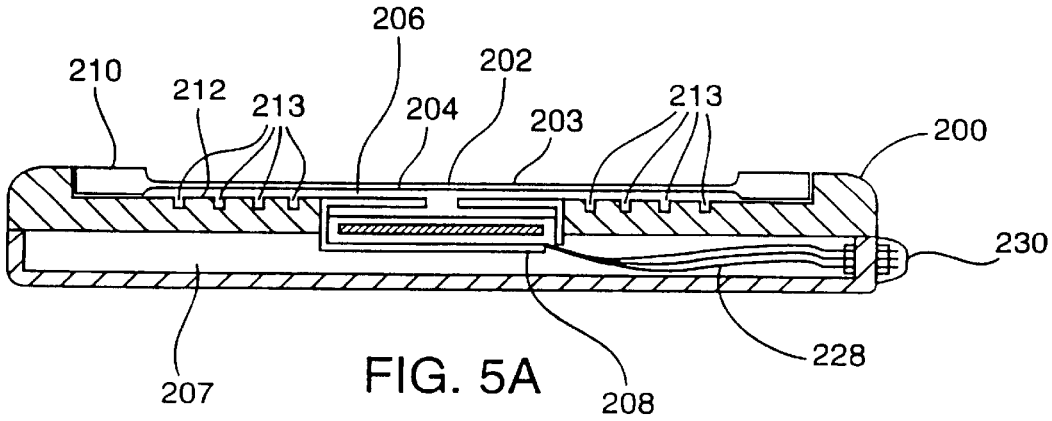
FIGS. 5A–5B show a cross-sectional view of an implantable microphone with an air cavity and surface details.
Figure 5B:
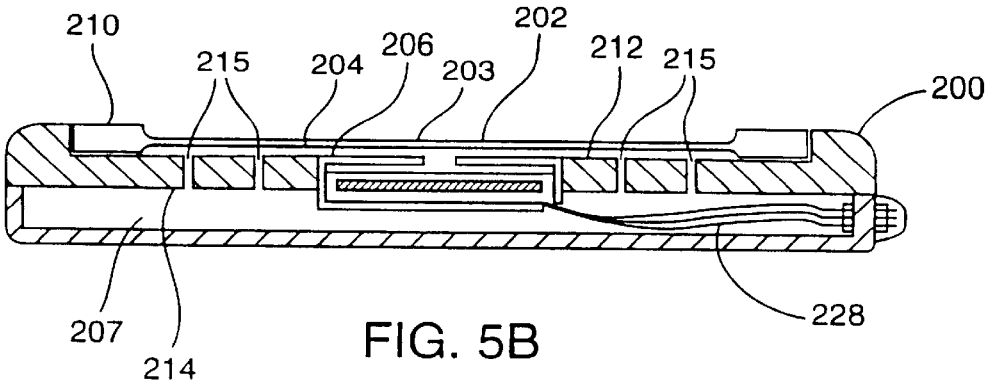

FIGS. 5A–5B show a cross-sectional view of an implantable microphone device with a primary cavity and surface details. In another embodiment of the implantable microphone device, a surface of the housing 212 immediately opposite the lower surface 204 of the diaphragm 202 will have fabricated surface details such as pits or grooves 213. The pits or grooves 213 are configured such that peak resonance damping may be optimized. In yet another embodiment of this concept, the primary air cavity 206 will have at least one hole 215 which connects the primary air cavity 206 to the rear, or internal, chamber 207. The result of the communication between the primary air cavity and the rear chamber is the formation of a resonance chamber for response shaping. The diameter of the hole or holes may, for example, be less than 0.020". Preferably, both cavities will remain hermetically sealed to the outside.

Figure 6:
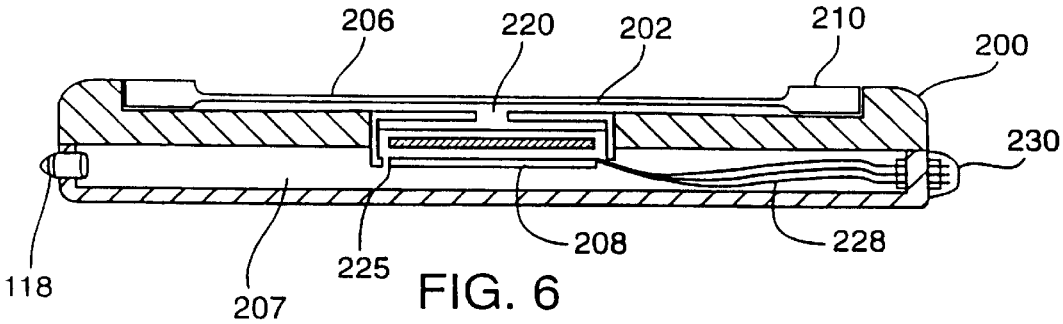
FIG. 6 shows a cross-sectional view of an implantable microphone with a vented electret microphone.

FIG. 6 shows a cross-sectional view of an implantable microphone device with an internally vented microphone arrangement 208. The internally vented microphone arrangement is another embodiment of the present invention which has a diaphragm 202, a housing 200, a microphone arrangement 208 and a rear, or internal, chamber 207. In this embodiment, the microphone arrangement 208 comprises a secondary air cavity 226, an electret membrane 222, a back plate 224, an aperture 220 and a vent 225. The aperture 220 connects the secondary air cavity 226 to the primary air cavity 206 so that vibrations of the diaphragm are transmitted through the primary air cavity 206 through the aperture 220 to the secondary air cavity 226. A vent 225 is provided to connect a cavity 227 operatively behind the secondary air cavity 226 to the rear chamber 207. The rear chamber 207 encases the microphone leads 228. The portion of the housing 200 which surrounds the rear chamber further comprises a feedthrough 230 and a gas-fill device 118. The gas-fill device enables filling of the microphone device 100 with specialty gases, such as Xenon. The membrane 222 typically has a small pressure relief hole extending therethrough to communicate cavities 226, 227 with one another. Because of the aperture 220, vent 225, and the pressure relief hole in the membrane 222, the gas is allowed to permeate the interior of the microphone device. Conversely, gas can be evacuated from the interior of the microphone device as well. The device 118 can typically be a hollow thin-walled tube which can be easily sealed using a crimp-induced cold weld or other similar means for sealing the tube. In another embodiment, the surface of the housing 212 may have surface details, such as holes (FIG. 5B) which will also allow a gas to permeate from the rear chamber 207 to the primary cavity 206. In all instances it is preferred that the cavities within the device remain hermetically sealed from the outside.

Figure 7:
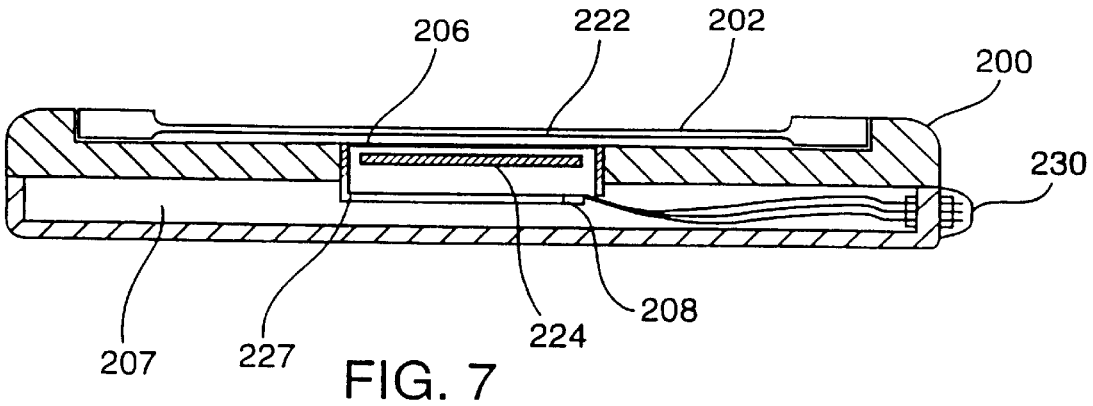
FIG. 7 shows a cross-sectional view of an implantable microphone with an exposed electret microphone.

FIG. 7 shows a cross-sectional view of an implantable microphone device with an exposed electret microphone membrane. Another embodiment of the present invention provides an implantable microphone device having a membrane 202, a housing 200, a microphone arrangement 208 and a rear chamber 207. The microphone arrangement 208, is an electret microphone, that has been modified such that the membrane 222 is directly exposed to the primary air cavity 206. This is accomplished by eliminating the top of the microphone protective cover 227, thus eliminating the aperture 220 and the secondary air cavity 226, as well. Exposing the electret membrane 222 directly to the primary air cavity 206 reduces the volume of the air cavity 206. Accordingly, the acoustic compliance of the primary cavity is decreased and the performance may be improved.

Figure 8A:
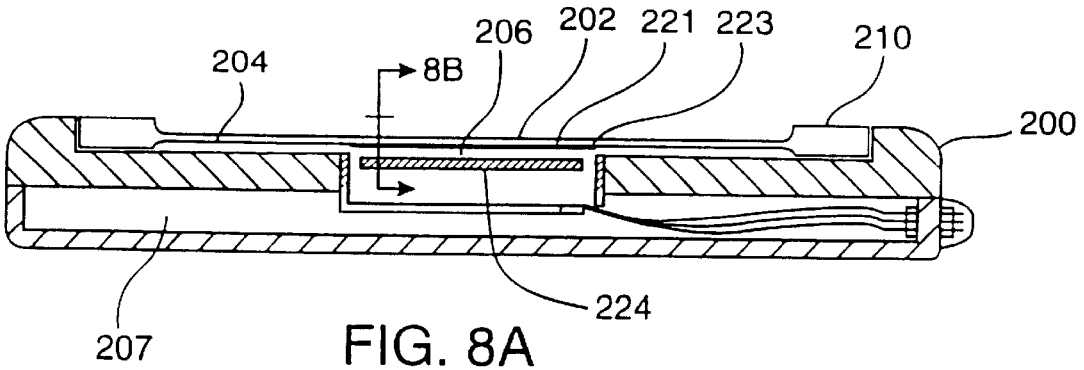
FIG. 8A–8B shows a cross-sectional view of an implantable microphone with an electret microphone with no electret membrane and a cross-sectional view of the membrane of this embodiment, respectively.
Figure 8B:
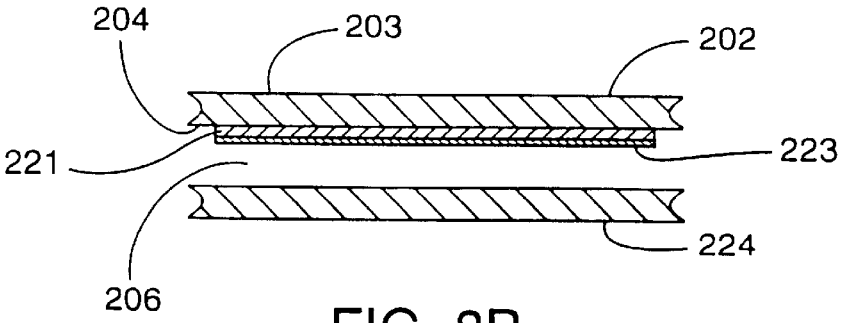

FIG. 8A shows a cross-sectional view of an implantable microphone device with an electret microphone having no electret membrane. Another embodiment of the present invention, contains an electret microphone that has been modified such that the electret membrane 222 (See FIG. 7) is eliminated. The lower surface 204 of the diaphragm 202 has an insulation layer 221 secured directly on to the lower surface of the diaphragm 204. An electret membrane-type material 223 is placed directly onto the insulation layer 221. This material could be, for example, polyvinylidene fluoride (PVDF), Teflon® FEP, or single-side metallized mylar. FIG. 8B shows a cross section of the diaphragm 202 with the various layers attached. The backplate 224 is placed in close proximity to the PVDF layer 223 and is disposed within the air cavity. In this configuration, the diaphragm 202 will function as the membrane of the electret microphone. The primary air cavity volume 206 is considerably reduced which further decreases its acoustic compliance.

Figure 9:
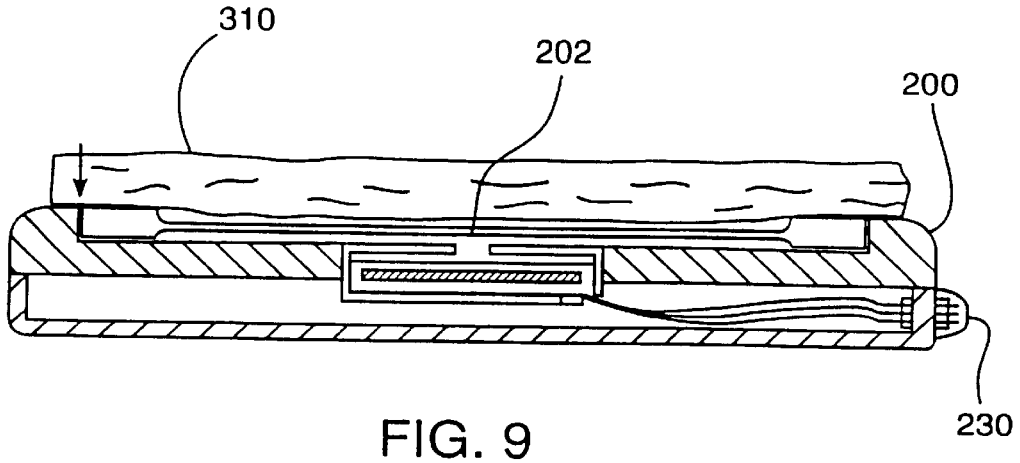
FIG. 9 shows a cross-sectional view of an implantable microphone with a biocompatible material.

FIG. 9 shows a cross-sectional view of an implantable microphone device with a biocompatible material. Since the implantable microphone device is to be received into the human body it may be coated with a protective biocompatible material. The coating (not shown) may be parylene or similar substance and will completely encapsulate the microphone to aid in biocompatability. In a preferred embodiment, a biodegradable material 310 may be placed directly in front of the diaphragm 202. In this configuration, the initial tissue growth that typically occurs after surgical implantation (the healing process) would not be allowed to impinge on the microphone diaphragm 202. Human tissue that impinges or adheres to the diaphragm 202 may affect its frequency response. Preferably, the material will degrade over time and be absorbed into the body. After the healing process is concluded, the volume of space occupied by the biodegradable material 310 will fill with body fluids. Biodegradable materials suitable for this embodiment include lactide and glycolide polymers. The materials may be held in place by the protective cover or made to adhere to the diaphragm surface.

Figure 10:
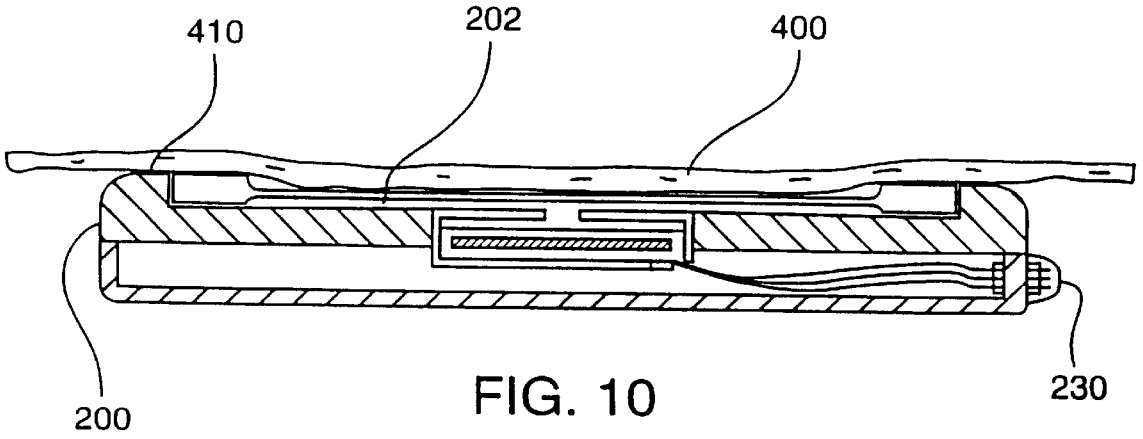
FIG. 10 shows a cross-sectional view of an implantable microphone with synthetic skin.

FIG. 10 shows a cross-sectional view of an implantable microphone device with "synthetic skin". In another embodiment of the present invention, a synthetic skin 400 or similar material, is made to adhere 410 to the diaphragm 202. This patch 400 can be sewn to the edges of the skin of a patient, taking the place of the real skin removed by a surgeon. Placement could be anywhere on the side of the head, or it could be used in place of a tympanic membrane.

A preferred embodiment of an implantable microphone device, in accordance with the invention, will now be described with reference to FIGS. 11–17. The preferred implantable microphone device in accordance with the invention is generally indicated by reference numeral 510.

Figure 13:
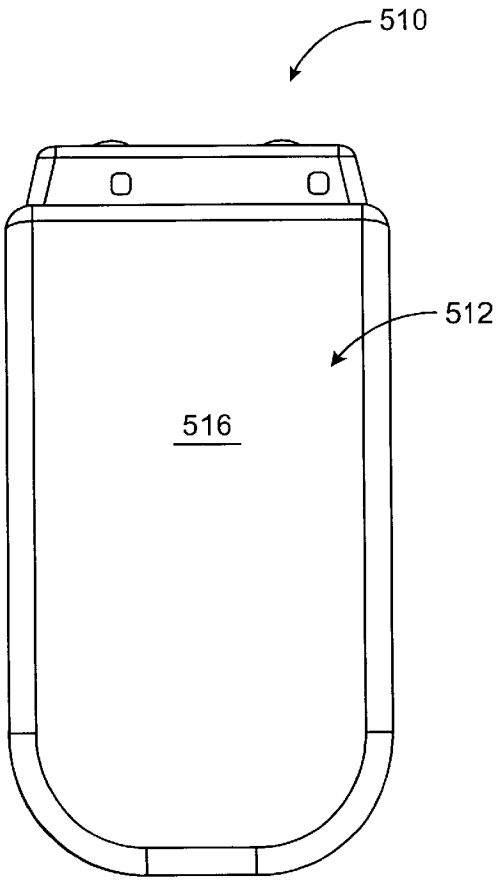
FIG. 13 shows a bottom view of the device shown in FIGS. 11 and 12.
Figure 12:
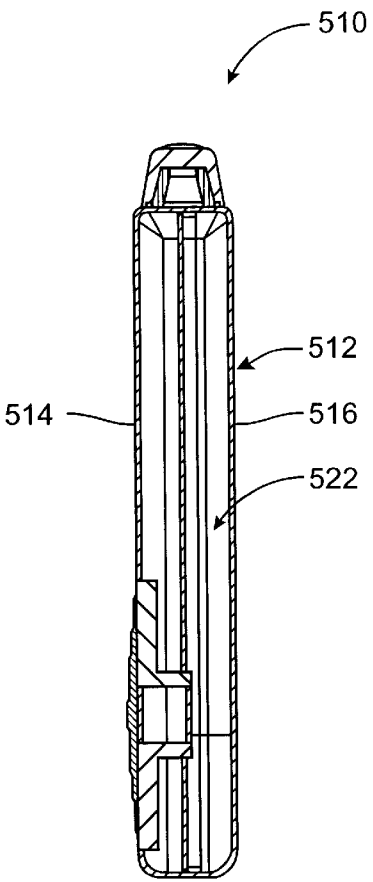
FIG. 12 shows a cross-sectional side view of the device shown in FIG. 11, along arrows A—A.
Figure 11:
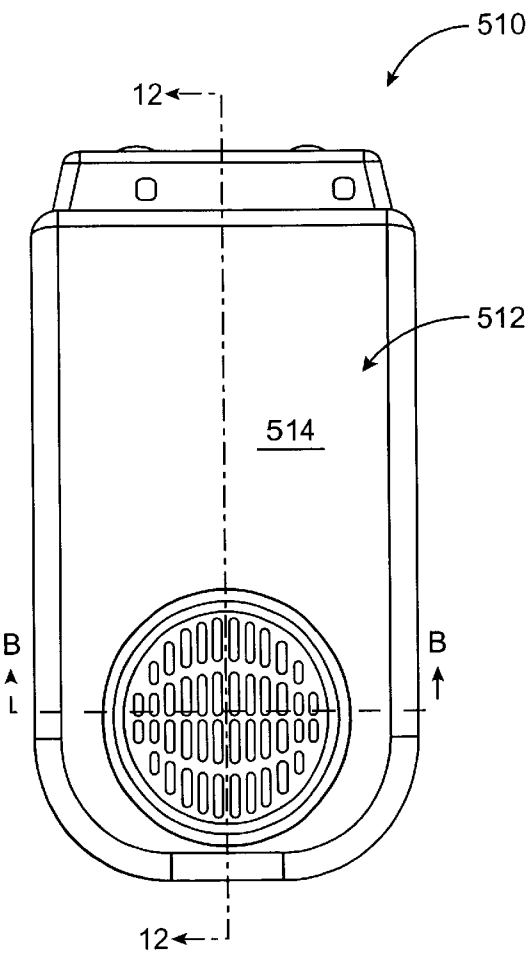
FIG. 11 shows a schematic plan view of a preferred implantable microphone device in accordance with the invention.

Referring initially to FIGS. 11–13, the device 510 includes a housing 512. The housing 512 comprises a top cover portion 514 and a bottom cover portion 516. The top and bottom cover portions are typically sealingly secured together in any appropriate manner, such as, by means of conventional fasteners, e.g., screws, or the like, by means of snap-engaging elements, by means of adhesive, or the like. Preferably, they are secured together by laser welding.

Figure 15:
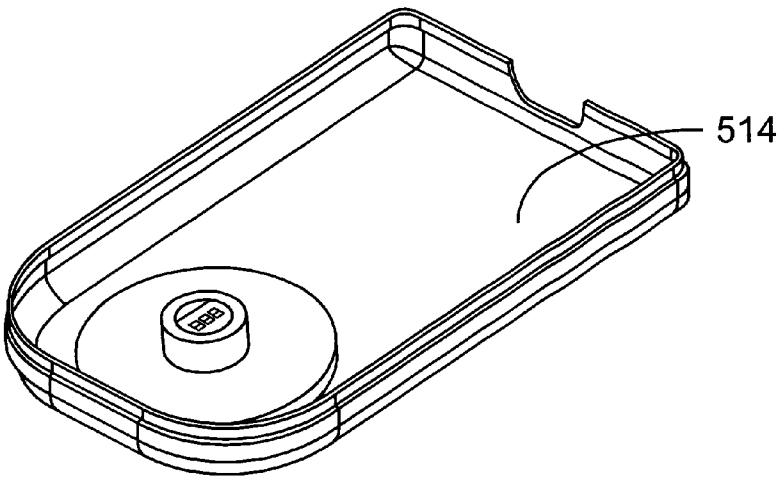
FIG. 15 shows a schematic three-dimensional view corresponding to FIG. 14, but in an assembled condition.
Figure 14:
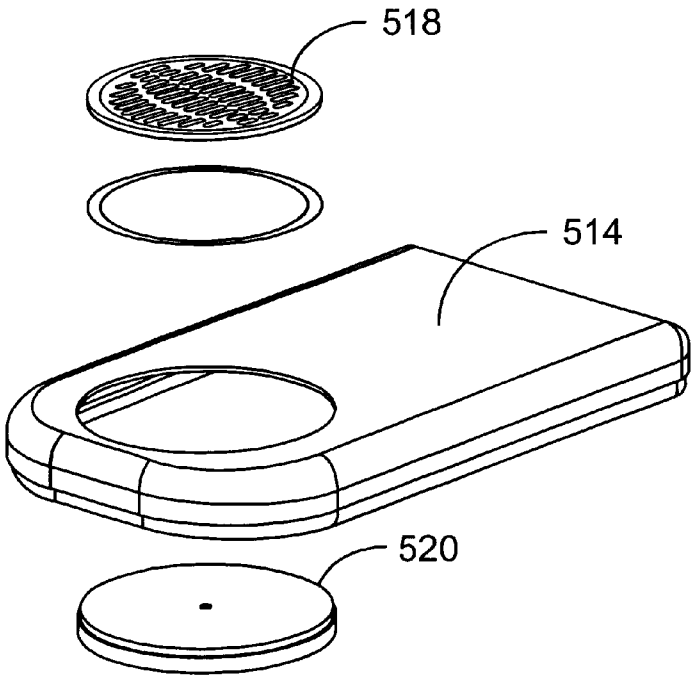
FIG. 14 shows an exploded view of a top cover portion of the device shown in FIGS. 11–13.

Referring now to FIGS. 14 and 15, the top cover 514 comprises a protective cover 518. The protective cover 518 typically extends over a diaphragm 520 as will be described in greater detail herein below. When the covers 514 and 516 are secured together, the housing 512 defines an internal chamber 522 as can best be seen with reference to FIGS. 12, 16 and 17.

Figure 16:
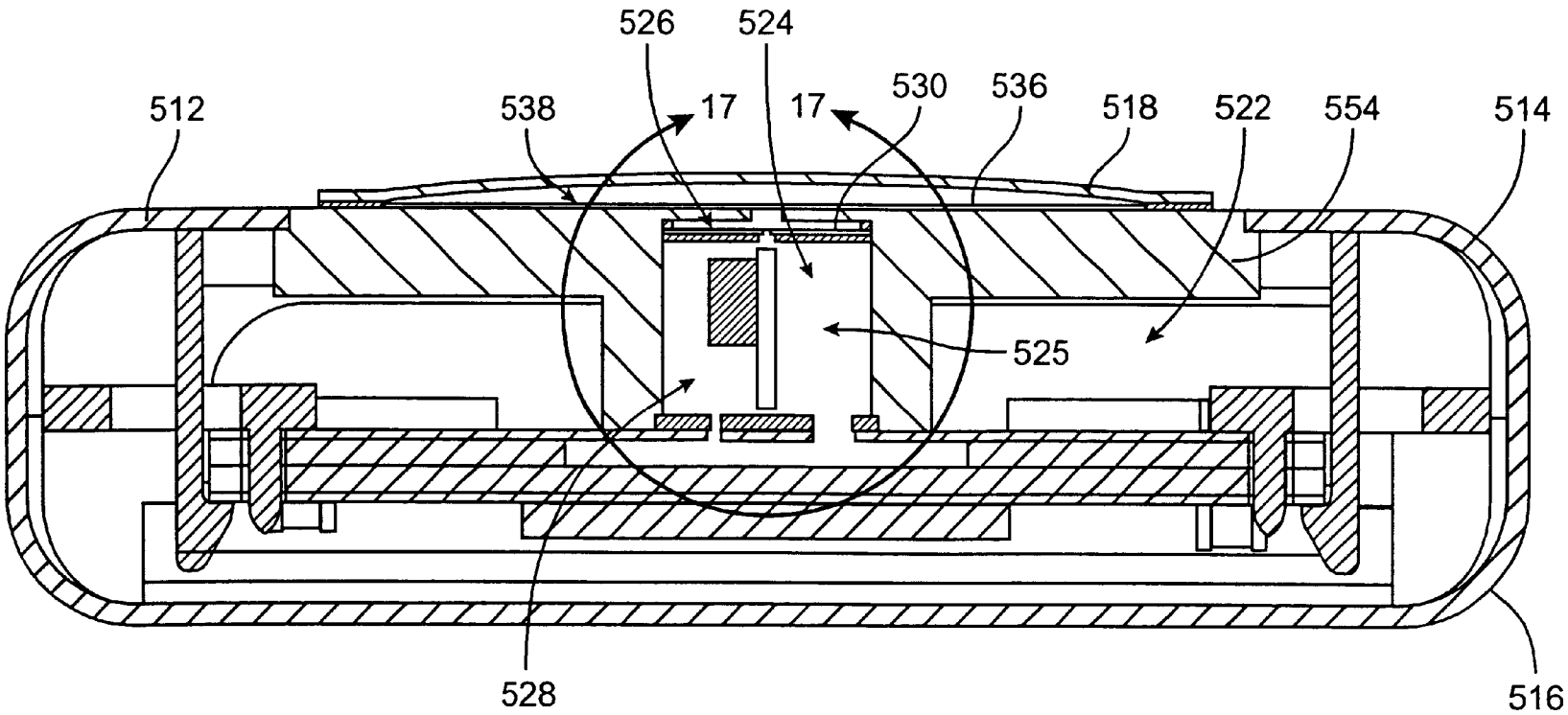
FIG. 16 shows on an enlarged scale, a schematic cross-sectional end view along arrows B—B in FIG. 11.
Figure 17:
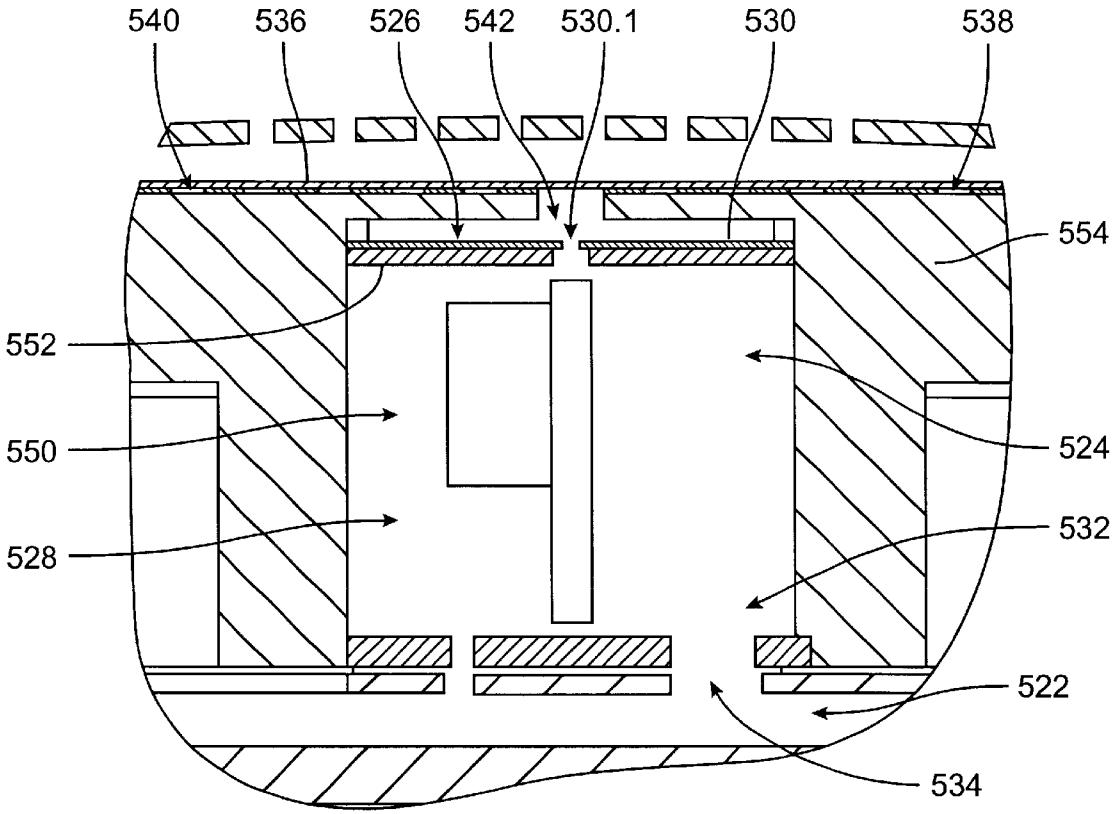
FIG. 17 shows an enlarged view of the window C indicated in FIG. 16.

Referring now to FIGS. 16 and 17, the implantable microphone device 510 comprises a microphone arrangement generally indicated by reference 524. The microphone arrangement 524 has an internal cavity 525 divided into a first cavity 526 and a second cavity 528. A membrane 530 separates the first and second cavities 526, 528 respectively. In use, vibrations entering the first cavity 526 cause the membrane 530 to vibrate, thereby causing the vibrations to be transmitted into the second cavity 528. The microphone device 510 further comprises a vent arrangement 532 defining at least one vent 534 extending between the second cavity 528 of the microphone arrangement 524 and the internal chamber 522 of the housing 512 so as to permit the vibrations to pass from the second cavity 528 of the microphone arrangement 524 into the internal chamber 522 of the housing 512. The internal chamber 522 then serves as a resonance chamber for response shaping. The device 510 further comprises a diaphragm 536 and a primary cavity 538. The primary cavity 538 extends between the diaphragm 536 and a face 540 of the housing 512. An aperture 542 extends between the primary cavity 538 and the first cavity 526 of the microphone arrangement. It will be appreciated that a cavity similar to the first cavity 526 was referred to as a secondary air cavity in the previous embodiments. Accordingly, when the diaphragm 536 is caused to vibrate, vibrations are transmitted into the primary cavity 538 so as to enter the first cavity 526 of the microphone arrangement 524 through the aperture 542.

Referring to FIG. 16, the diaphragm 536 is mounted on the housing 512 and the primary cavity 538 is defined between the diaphragm 536 and the housing 512. The diaphragm 536 extends across the face 540 of the housing 512.

Referring again to FIG. 17 of the drawings, the device 510 further comprises a microphone transducer, generally indicated by reference number 550 positioned within the second cavity 528 of the microphone arrangement 524. The microphone transducer 550 typically cooperates with a backplate 552 so as to detect vibrations of the membrane 530. The membrane and backplate arrangement functions capacitor-fashion so that varying voltage is generated in response to vibration of the membrane 530 relative to the backplate 552. This varying voltage is detected by the transducer 550. Leads (not shown in FIGS. 11–17) extend from the transducer 550 to a position outside the microphone device 510 as shown in FIG. 1. A small hole 530.1 is provided in the membrane 530. The hole 530.1 serves as a pressure relief valve between cavities 526, 528. It can also serve as a high pass filter to block out lower frequencies.

The microphone arrangement 524 can be defined by an electret microphone. Instead, the microphone arrangement can be formed in a base 554 by etching or by any other appropriate forming technique. Circuit boards, batteries, and the like can be contained in the housing 512 if desired.

While the above is a complete description of preferred embodiments of the invention, various alternatives, modifications and equivalents may be used. It should be evident that the present invention is equally applicable by making appropriate modifications to the embodiments described above. For example, the above has shown that the implantable microphone and audio processor are separate; however, these two devices may be integrated into one device. Therefore, the above description should not be taken as limiting the scope of the invention which is defined by the metes and bounds of the appended claims along with their fill scope of equivalents.

What is claimed is:

1. An implantable microphone device, comprising:

a housing defining a surface and a rear chamber;

a diaphragm coupled to the housing, the diaphragm being a substantially unstressed diaphragm and being disposed over the surface of the housing to define a primary cavity therebetween;

a device through which a gas can be removed from or introduced into the rear chamber;

a microphone arrangement on the housing, the microphone arrangement having an aperture open to the primary cavity, an internal cavity coupled to the primary cavity through the aperture so that vibrations of the diaphragm are transmitted through the primary cavity and aperture into the internal cavity, and a vent connecting the cavity to the rear chamber; and a microphone transducer disposed in the cavity of the microphone arrangement so as to detect said transmitted vibrations.

2. The device of claim 1, wherein the surface of the housing comprises surface details.

3. The device of claim 1, wherein the primary cavity, the internal cavity, and the rear chamber are filled with a gas comprising a constituent gas selected from the group consisting of air, argon, helium, xenon, nitrogen, and sulfur hexafluoride.

4. The device of claim 1, in which leads extend from the microphone arrangement and wherein the housing further comprises a hermetic feedthrough through which the leads extend to a position outside the housing.

5. The device of claim 1, further comprising a protective cover extending over the diaphragm.

6. The device of claim 5, wherein the protective cover is a perforated cover.

7. The device of claim 1, wherein a central portion of the diaphragm is etched or formed to a thickness of between 0.0005" and 0.0025".

8. The device of claim 1, wherein the diaphragm comprises at least one compliance ring.

9. The device of claim 8, wherein the at least one compliance ring is either etched or formed.

10. The device of claim 1, wherein the housing and diaphragm are of a material comprising titanium.

11. The device of claim 10, wherein the diaphragm is laser welded to the housing.

12. The device of claim 1, wherein the housing is encapsulated in a biocompatible material.

13. An implantable microphone device comprising:

a housing defining an internal chamber;

a microphone arrangement on the housing, the microphone arrangement having a first cavity, a second cavity and a membrane separating the first and second cavities such that vibrations entering the first cavity cause the membrane to vibrate thereby causing the vibrations to be transmitted into the second cavity; and at least one vent extending between the second cavity of the microphone arrangement and the internal chamber of the housing so as to permit the vibrations to pass from the second cavity of the microphone arrangement into the internal chamber of the housing.

14. The device of claim 13, which further comprises a diaphragm, a primary cavity, defined at least in part by the diaphragm, and an aperture extending between the primary cavity and the first cavity of the microphone arrangement, such that when the diaphragm is caused to vibrate, vibrations are transmitted into the primary cavity so as to enter the first cavity of the microphone arrangement through the aperture.

15. The device of claim 14, wherein the diaphragm is mounted on the housing and the primary cavity is defined between the diaphragm and the housing.

16. The device of claim 15, wherein the diaphragm extends across a face of the housing.

17. The device of claim 16, wherein the face of the housing comprises surface details.

18. The device of claim 15, which further comprises a microphone transducer positioned within the second cavity of the microphone arrangement so as to detect vibrations of the membrane, and leads extending from the transducer.

19. The device of claim 18, wherein the microphone arrangement is defined by an electret microphone, the membrane then being an electret membrane and the transducer comprising a backplate from which the leads extend.

20. The device of claim 18 or 19, wherein the leads extend from the microphone arrangement to a position outside the housing, the housing having a hermetic feedthrough through which the leads extend.

21. The device of claim 15, wherein the primary cavity, the first and second cavities of the microphone arrangement, and the internal chamber of the housing are filled with a gas comprising a constituent gas selected from the group consisting of air, argon, helium, xenon, nitrogen, and sulfur hexafluoride.

22. The device of claim 15 further comprising a protective cover extending over the diaphragm.

23. The device of claim 22, wherein the protective cover is a perforated cover.

24. The device of claim 22, wherein the protective cover is a wire grid.

25. The device of claim 15, wherein the diaphragm is substantially unstressed.

26. The device of claim 15, wherein a peripheral portion of the diaphragm is thicker than a central portion thereof.

27. The device of claim 26, wherein a central portion of the diaphragm is etched or formed to a thickness of between 0.0005" and 0.0025".

28. The device of claim 15, wherein the diaphragm comprises at least one compliance ring.

29. The device of claim 28, wherein the at least one compliance ring is either etched or formed.

30. The device of claim 15, wherein the housing and diaphragm are composed of titanium.

31. The device of claim 30, wherein the diaphragm is laser or projection welded to the housing.

32. The device of claim 15, wherein the diaphragm has a free standing resonant frequency in air below 12,000 Hz.

33. The device of claim 15, wherein the primary cavity defines a volume having an acoustic compliance of less than $4.3\times10^{-14}$ $m^2/N$.

34. The device of claim 15, wherein the primary cavity defines a volume of less than 6 $mm^3$.

35. The device of claim 15, wherein the diaphragm deflects no less than 0.015" per pound over the range of 0.05 to 0.25 lbs. when subjected to a centered force from a spherical tipped 3/32" rod.

36. The device of claim 15, wherein the housing is completely encapsulated by a biocompatible material.

* * * * *